United States Patent [19]

Waldman

[11] Patent Number: 4,520,923

[45] Date of Patent: Jun. 4, 1985

[54] CONTACT LENS HOLDER

[76] Inventor: Fred Waldman, 8929 E. Jewell Cir., Denver, Colo. 80231

[21] Appl. No.: 584,557

[22] Filed: Feb. 29, 1984

Related U.S. Application Data

[63] Continuation-in-part of Ser. No. 396,233, Jul. 8, 1982.

[51] Int. Cl.[3] ..... A45C 11/04

[52] U.S. Cl. ..... 206/5.1; 206/815

[58] Field of Search ..... 206/5.1, 815

[56] References Cited

U.S. PATENT DOCUMENTS

| | | | |
|---|---|---|---|
| 3,312,368 | 4/1967 | Reynolds et al. | 220/359 |
| 3,338,462 | 8/1967 | Reynolds et al. | 220/359 |
| 3,391,847 | 7/1968 | Christine et al. | 220/359 |
| 3,655,503 | 4/1972 | Stanley et al. | 161/165 |
| 4,009,777 | 3/1971 | Thomas | 206/5.1 |
| 4,029,033 | 6/1977 | Kerwin et al. | 220/359 |
| 4,034,132 | 7/1977 | Manuel | 220/359 |
| 4,163,506 | 8/1979 | Patterson | 220/359 |
| 4,167,234 | 9/1979 | Gordon et al. | 220/359 |
| 4,200,187 | 4/1980 | Thomas | 206/5.1 |
| 4,210,255 | 7/1980 | Pan | 220/359 |
| 4,244,466 | 1/1981 | Arnhem | 206/5.1 |
| 4,280,653 | 7/1981 | Elias | 220/359 |
| 4,328,890 | 5/1982 | Thomas et al. | 206/5.1 |

*Primary Examiner*—Joseph Man-Fu Moy

[57] ABSTRACT

A dome shaped contact lens holder is provided with indentations on its sides to allow finger tip contact with the underside of the rim of the contact lens resting on the crown of the dome. A strap capable of encompassing the lens and dome is attached on one end of the rear of the dome. At its other end, the underside of the strap is provided with a tip which plugs into a receiver located under the dome. The holder is made of a soft plastic material and comprises a single unit which is attached to the underside of the cap used to close the case containing the soaking solution in which the contact lens is stored.

6 Claims, 3 Drawing Figures

Fig. 1
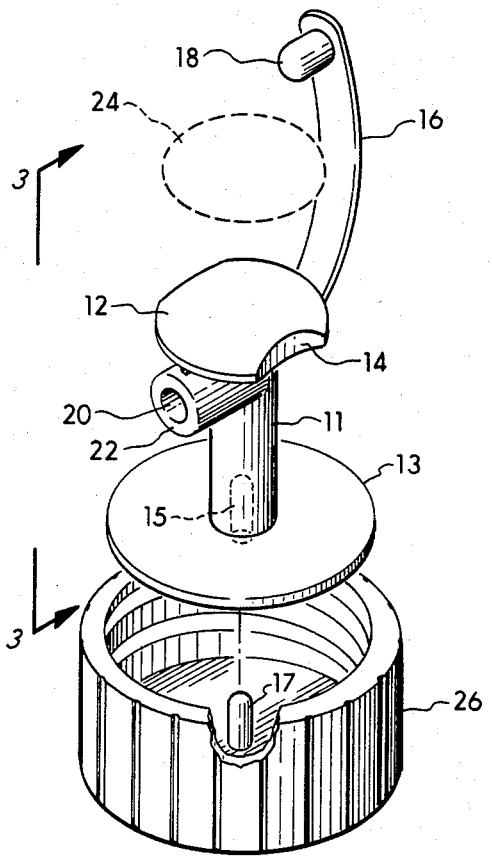
Fig. 3
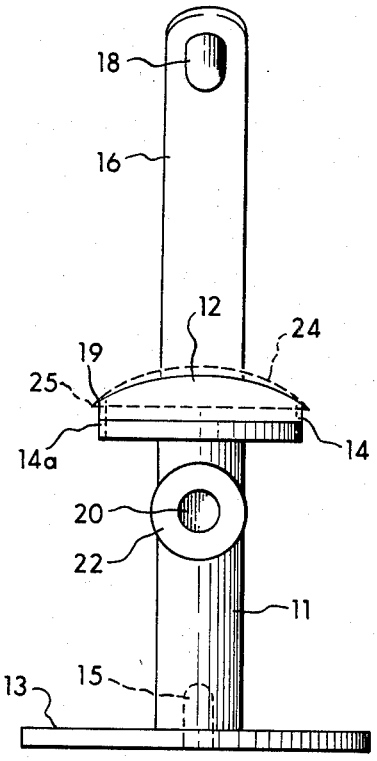
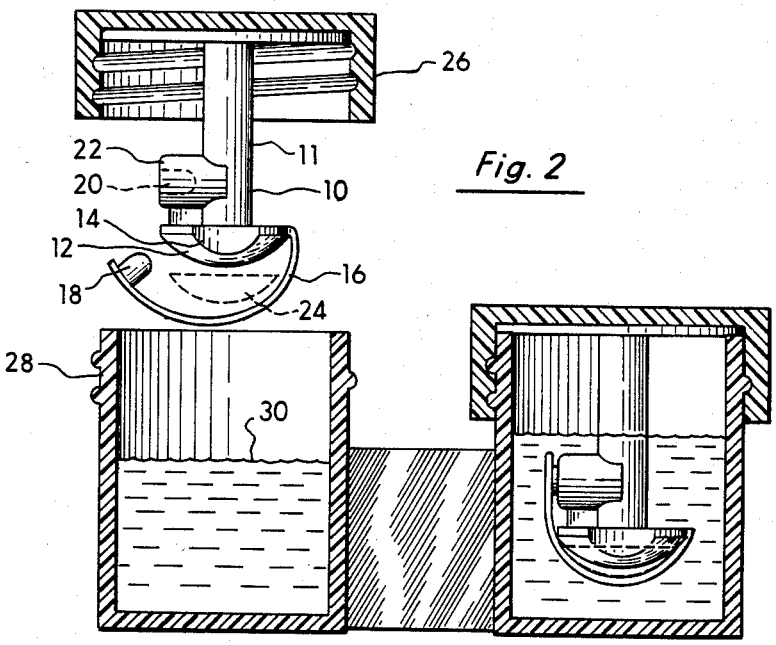
Fig. 2

CONTACT LENS HOLDER

This patent application is a continuation-in-part of my previous patent application, Ser. No. 396,233 filed July 8, 1982.

BACKGROUND OF THE INVENTION

1. Field of the Invention

This invention relates generally to contact lens storage cases, and more particularly to contact lens storage cases having domes for holding contact lenses while they are immersed in soaking solution contained in the storage cases.

2. Description of the Prior Art

Storage cases having hard plastic domes for holding contact lenses while they are suspended in soaking solutions are well known. Representative patents disclosing such domes are found in U.S. Pat. Nos. 3,770,113; 3,997,049, and 3,990,579. As seen in FIG. 3 of U.S. Pat. No. 3,997,049 and FIG. 1 of U.S. Pat. No. 3.770,113 hard plastic domes of this type are very often attached to stems which are, in turn, attached to the inside of the cap which closes the storage case. As can be seen in the drawings accompanying these patents, the domes can be enclosed by hinged covers which encompass the contact lenses and the domes upon which they rest. The covers are made of a hard plastic and usually have apertures for allowing the soaking solution to contact the lens. These covers are also provided with a locking means such as prongs which engage with a biased catch near the base of the dome by a pressure fit and thereby hold the cover closed over the dome. Finger pressure is used to overcome the bias of the receiver to open the cover. Usually the hinge at the back of the cover and the prong at the front of the cover engage with their respective cooperating parts at or near the base of the dome. Therefore, the edges of the contact lenses, particularly so called soft contact lenses, are sometimes crimped or pinched by either the hard plastic prongs or by the hinges when the cover is closed down upon a lens which has slipped from the crown of the dome. When the lens does slip from the crown of the dome it is not uncommon for it to come to rest beyond the base of the dome. When this happens it can be damaged by the descending prong or the fulcrum formed at the hinge. Furthermore the base of these domes often rest in a tray-like base. There is very little room between the sides of the tray and the dome. When, due to the suction forces created between the lubricated concave side of the lens and the dome, a lens gets stuck on the dome there is usually not enough room to get a finger tip between the sides of the tray and the dome to lift the rim of the lens and break the suction forces. When confronted with this problem most users usually retrieve the lens by pinching it between their thumb and index finger. This action often proves to be injurious to soft contact lenses. Furthermore the holders with their trays, domes, hinged covers, suspension devices and other parts are made individually and then precisely assembled for correct mechanical operation. These features tend to lead to relatively costly contact lens storage cases which must sometimes be replaced when individual parts are lost. Applicant has found that potential damage to contact lenses, particularly soft contact lenses, caused by both the mechanical operation of the holder in which the lens is stored, and by the act of overcoming the suction forces which may hold the lens to the dome, can be minimized by use of a single unit, mushroom shaped holder having indentations in the side of the dome and a cover comprised of a strap which engages with a receiver located under the dome.

SUMMARY OF THE INVENTION

The present invention provides a simple and inexpensive holder for contact lenses that can be suspended within a case which contains a contact lens soaking solution. The holder consists of a minimum number of soft plastic parts which are molded together into a single unit. The dome and its associated stem have a mushroom shaped configuration. The dome is further characterized by having at least one, and preferably two, indentation(s) in its side for finger tip contact with the underside of the rim of the contact lens which rests on the crown of the dome. A strap capable of encompassing the lens and dome is attached on one end to the rear of the dome. At its other end, the strap is provided with means for connecting the strap to a receiver located on the stem under the dome. The connecting means could be any number of hooking or latching systems known to the art, but applicants prefer, for the sake of simplicity of molding the parts, to place a tip on the underside of the strap. This tip, via a pressure fit, is held inside a hole in a receiver which resembles a branch leading off the stem near the underside of the dome. The holder can be molded as a single unit from any number of soft plastic forming materials commonly referred to as "elastomers" in the molding and injection molding arts. The elastomer known by the trade name Kraton is a preferred material since it cures into a soft plastic material having the proper elastic qualities for the strap as well as the proper body for the dome and stem portions of the holder.

The base of the stem is attached to the underside of the cap which closes the top of the storage case. When the cap is screwed on top of the case, the dome and hence the lens strapped to the dome, hangs upside in the soaking solution. The base of the stem can be attached to the underside of the cap in any number of ways. For example, the stem can be compression fitted into a base recepticle on the underside of the dome. However, a preferred method for attaching the stem to the cap is to mold a small hole in the center of the base of the stem. The underside of the cap can be provided with a tip which protrudes upward into the hole in the stem in a pressure fit. Another preferred method for attaching the stem to the underside of the cap is to mold a dish-like base to the stem as part of the original molding process. The base is most preferably of a size such that it pressure fits within the inside diameter of the cap so that the base acts as a gasket between the cap and the top of the storage case. In conjunction with this gasket system, a hole extending through the base and possibly into the stem can also be provided to engage a tip which protrudes from the underside of the cap.

BRIEF DESCRIPTION OF THE DRAWINGS

FIG. 1 shows an exploded perspective view of the contact lens holder of this invention.

FIG. 2 shows a side perspective view of the holder suspended from the cap of the case and another holder immersed in the soaking solution.

FIG. 3 shows a front cross sectional view of the dome, stem and receiver.

DETAILED DESCRIPTION

While this invention is susceptible of embodiment in a number of different forms, there is shown in the drawings and will herein be described in detail two specific embodiments. It is to be understood that the embodiments are to be considered as exemplary of the principles of the invention and are not intended to limit the invention only to the two embodiments illustrated.

FIG. 1 of the drawings shows elements that comprise the contact lens holder about to encompass the contact lens to be stored. The elements making up the holder are constructed to hold a contact lens on the crown of the dome. The dome is then suspended within the container as indicated in FIG. 2 so that the lens can be sterilized and/or stored when they are not in use. The holder has a stem 11 with a dome 12 at one end and, optionally, a base 13 at the other end. The dome 12 has at least one indentation 14 in its side so that a finger tip can be used to pull up on the rim of the contact lens 24 in the event the lens 24 is held to the dome 12 by suction forces created by the presence of a contact lens soaking solution. The holder is provided with a strap 16 capable of encompassing the lens 24 and dome 12 and detachably connecting with a connector means 22. The strap 16 should be long enough to hold the lens 24 in a moderately snug fit against the crown of the dome 12. Preferably the detachable connection between the strap 16 and the receiver means 22 is achieved by molding a tip 18 on the underside of the strap 16 and molding a hole 20 in the connector means 22. The tip 18 should plug into the hole 20 in a compression fit. The base of the stem is shown provided with means for attaching the stem 11 to underside of the cap 26. In a preferred embodiment of this invention this attachment is accomplished by means of a tight compression fit between a hole 15 in the base of the stem and a tip 17 on the underside of the cap 26. In the most preferred embodiment of this invention the stem 11 is also provided with a base 13 which fits into the cap 26 and acts as a gasket between the cap 26 and the storage case shown in FIG. 2.

FIG. 2 shows the strap 16 of the lens holder 10 about to encompass the lens 24 and the dome 12. The strap 16 should be long enough that the tip 18 located near the end of the strap can be inserted into the hole 20 in the receiver means 22 attached to the stem 11 near the underside of the dome 12. Preferably the cap 26 acts in threaded engagement with the storage case 28 to seal the soaking solution 30 within the case. The right side of the case shows a in place so that the case is sealed and the contact lens is immersed in the soaking solution 30.

FIG. 3 is a front view of the holder. In a preferred embodiment the dome 12 is shown with indentations 14 and 14*a* on eash side of the dome 12. Preferably, the depth of the indentation of 14*a* is such that the rim 25 of the lens 24 extends slightly beyond the upper edge 19 of the indentation 14*a* so that a finger tip not shown can conveniently pry the lens 12 away from the dome 12 in the event they are held together by a suction force. The base of the stem is shown with a hole 15 for receiving a tip not shown which protrudes from the inside of the cap. Optionally, the stem can be provided with the base 13 which can be used to act as a gasket between the cap and the storage case. In the alternative, the stem 11 can be held to the cap by means of the tip 17 of the cap 26 not shown, inserted into the hole 15 in the stem 11.

The entire holder can be made as a single unit from a elastomeric material at a minimum cost to provide a holder to which contact lenses can be readily held for soaking and storage, and from whch contact lenses can be removed with minimal chances of the holders and/or the finger causing damage to the lenses. The foregoing is a brief description of the principle embodiments of this invention. However, it will be readily appreciated by those skilled in the art that there are numerous details therein which may be altered without departing from the spirit and scope of the present invention.

Thus, having disclosed my invention, I claim:

1. A contact lens holder comprising a stem terminating on one end in means for attaching the stem to the underside of a cap to a case for storing contact lens soaking solution and terminating on the other end in a dome, free of any surrounding sidewall, said dome having one or more cut out sections in its sides for exposing the underside rim of a contact lens positioned on said dome, and having a hinged strap, having a width less than the width of the dome, said strap being further provided with a connecting means for detachably connecting with a receiver means positioned on the side of the dome opposite the side to which the hinged strap is attached.

2. The contact lens holder of claim 1 wherein the means for attaching the stem to the underside of the cap is a gasket for the cap.

3. The contact lens holder of claim 1 wherein the strap is further provided with a tip which engages with a hole in the receiver.

4. The contact lens holder of claim 1 wherein the stem, dome, strap, receiver and means for attaching the stem to the underside of the cap are all made as a single unit of an elastomeric material.

5. The contact lens holder of claim 1 wherein the means for attaching the stem to the underside of the cap is a gasket for the cap.

6. The contact lens holder of claim 1 wherein the stem, dome, strap, receiver and means for attaching the stem to the underside of the cap are all made as a single unit of an elastomeric material.

* * * * *